US011930864B2

(12) United States Patent
Costanza

(10) Patent No.: US 11,930,864 B2
(45) Date of Patent: Mar. 19, 2024

(54) BRA LINER

(71) Applicant: Mary Anna Costanza, Farmington Hills, MI (US)

(72) Inventor: Mary Anna Costanza, Farmington Hills, MI (US)

( * ) Notice: Subject to any disclaimer, the term of this patent is extended or adjusted under 35 U.S.C. 154(b) by 293 days.

(21) Appl. No.: 17/482,333

(22) Filed: Sep. 22, 2021

(65) Prior Publication Data

US 2022/0087328 A1 Mar. 24, 2022

Related U.S. Application Data

(63) Continuation-in-part of application No. 29/803,446, filed on Aug. 12, 2021.

(60) Provisional application No. 63/081,817, filed on Sep. 22, 2020.

(51) Int. Cl.
*A41C 3/00* (2006.01)
*A41C 3/12* (2006.01)

(52) U.S. Cl.
CPC ..... *A41C 3/0014* (2013.01); *A41C 3/128* (2013.01)

(58) Field of Classification Search
CPC ..... A41C 3/10; A41C 3/0014
USPC ..... 450/37
See application file for complete search history.

(56) References Cited

U.S. PATENT DOCUMENTS 4,747,162 A * 5/1988 Yanagihara ..... A41D 27/13 2/58
5,790,982 A * 8/1998 Boutboul ..... A41D 27/133 2/53
6,074,272 A * 6/2000 Hebert ..... A61F 13/141 450/37
7,429,205 B1 * 9/2008 Huang ..... A41C 3/142 450/39
7,905,763 B1 3/2011 Frank
8,042,194 B2 * 10/2011 Connor ..... A61F 13/47236 604/389
8,277,276 B2 * 10/2012 Waitz ..... A41C 3/10 450/39
9,629,753 B2 4/2017 Golubovic
10,653,563 B2 5/2020 Lilien
11,206,875 B2 * 12/2021 Morrow Contreras ..... A41C 3/065

(Continued)

FOREIGN PATENT DOCUMENTS

WO WO2014009956 A1 1/2014

OTHER PUBLICATIONS

Wick Em, Bra Liner, Amazon, Apr. 2012.

*Primary Examiner* — Timothy K Trieu

(57) ABSTRACT

A bra liner is an apparatus that conforms under a breast and is positioned in between the breast and a bra cup. The apparatus includes a flat liner body and at least one piece of adhesive. The flat liner body presses against the underside of a breast and an inner surface of a bra cup. The flat liner body includes an absorbent layer and a backing layer. The absorbent layer collects and retains sweat from the breast. The absorbent layer is connected across the backing layer. The absorbent layer and the backing layer are coextensive with each other. The at least one piece of adhesive is distributed across the backing layer. The at least one piece of adhesive is fixed onto the backing layer, opposite to the absorbent layer. The apparatus further includes a sealing sheet to prevent the at least one piece of adhesive from sticking to unwanted surfaces.

5 Claims, 4 Drawing Sheets

(56) References Cited

U.S. PATENT DOCUMENTS

| | | | | |
|---|---|---|---|---|
| 2010/0041313 | A1* | 2/2010 | Castellano | A41C 3/144 450/86 |
| 2010/0105285 | A1* | 4/2010 | Shao | A41C 3/144 601/84 |
| 2013/0330502 | A1* | 12/2013 | Lewis | A41D 13/015 2/455 |
| 2014/0141693 | A1* | 5/2014 | Madden | A41C 3/04 450/37 |
| 2014/0302745 | A1* | 10/2014 | Golubovic | A61F 13/15 450/1 |
| 2015/0157062 | A1* | 6/2015 | Rickauer | A45D 44/00 450/57 |

* cited by examiner

BRA LINER

The current application claims a priority to the U.S. Provisional Patent application Ser. No. 63/081,817 filed on Sep. 22, 2021.

The current application is also a continuation-in-part (CIP) application of the U.S. design application Ser. No. 29/803,446 filed on Aug. 12, 2021.

FIELD OF THE INVENTION

The present invention generally relates to bras. More specifically, the present invention is a bra liner.

BACKGROUND OF THE INVENTION

Unfortunately, active women may become embarrassed by noticeable sweat marks around their breasts after playing tennis matches in the heat. When a woman's breasts sweat excessively, the sweat can cause irritation and discomfort in addition to embarrassment. Therefore, a need exists for absorbent liners designed for this specific purpose, so that women with this problem will have an easy and convenient way to avoid these embarrassing situations.

It is therefore an objective of the present invention to provide relief for breast sweat with a bra. The present invention serves as a thin protective barrier designed to prevent sweat from leaving obvious marks under a breast. The present invention features a U-shaped liner so that the present invention conforms to the shape of the bra cup and remains in place without slipping.

DETAILED DESCRIPTIONS OF THE INVENTION

Figure 1:
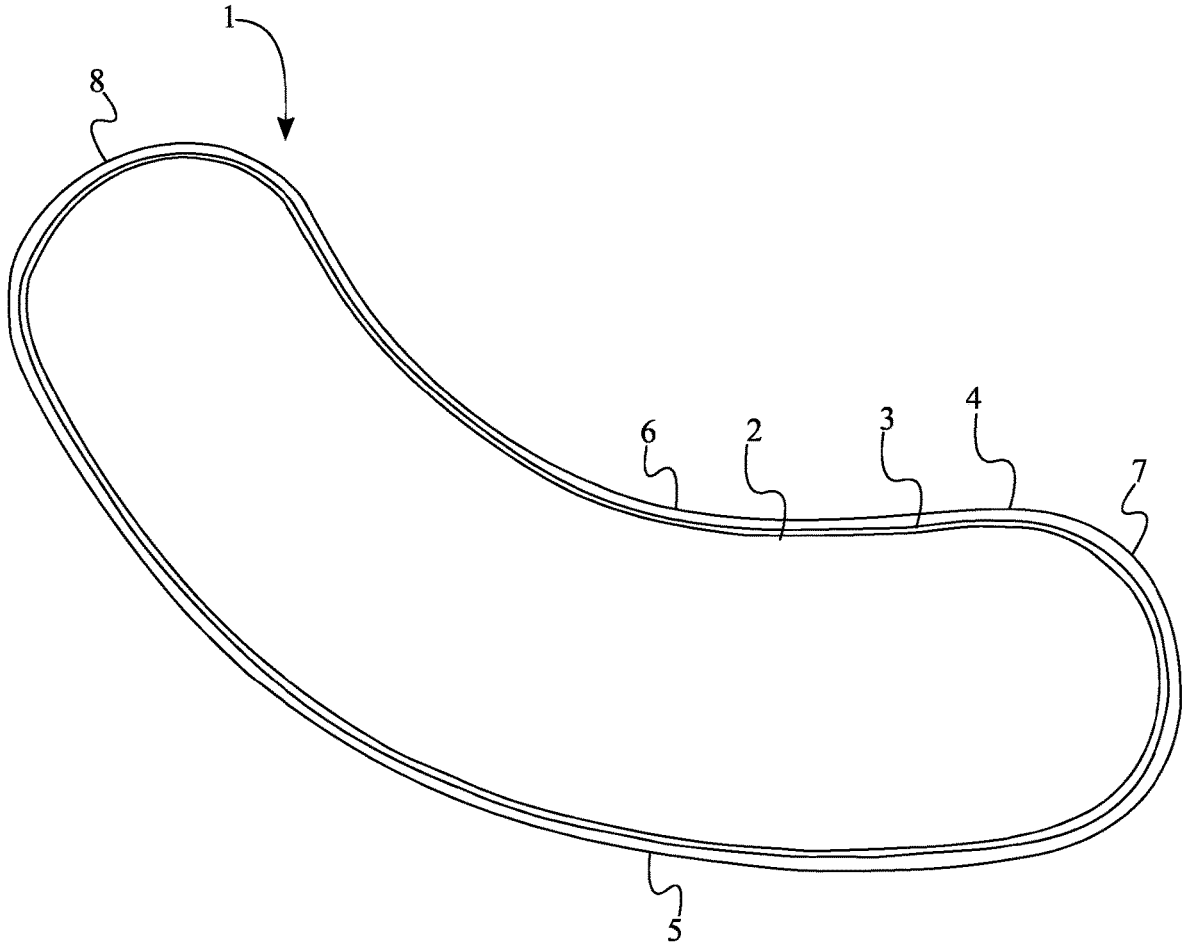
FIG. 1 is a front perspective view of the present invention.

All illustrations of the drawings are for the purpose of describing selected versions of the present invention and are not intended to limit the scope of the present invention.

The present invention is a bra liner. The present invention eliminates or significantly reduces the bra sweat seeping through a bra cup and a top of a user. More specifically, the present invention collects and retains the sweat from a breast of a user as a result of physical activity, increased temperature, anxiety and stress, and so on. The present invention discretely prevents embarrassing sweat stains on clothing. The present invention serves as a protective barrier for dryness between the sweat of a breast and the bra. The present invention prevents any chafing, rashes, and other skin irritations that typically result from a sweaty breast. Moreover, the present invention allows a user to feel more self-confident, cleaner, and fresher. The present invention serves as a comfortable lining for the underside of a breast and is superimposed across an inner surface of a bra cup. The present invention may comprise a flat liner body 1 and at least one piece of adhesive 9, seen in FIG. 1, FIG. 2, FIG. 3, and FIG. 4. The flat liner body 1 contours around and underneath the breast of the user and absorbs the sweat of a breast. The flat liner body 1 may comprise an absorbent layer 2 and a backing layer 3. The absorbent layer 2 collects and retains the sweat from the breast. The absorbent layer 2 is made of a sweat-absorbing material. The backing layer 3 presses against a bra cup and prevents the sweat from coming into contact with the bra cup. The backing layer 3 is a perforated plastic film. The at least one piece of adhesive 9 secures the desired position of the present invention across the inner surface of a bra cup and along the underside of a breast. The at least one piece of adhesive 9 is preferably made of tape that temporarily attaches the flat liner body 1 to the bra cup. It is understood that a user utilizes a first flat liner body 1 and a second flat liner body 1 for both breasts. It is also understood that the present invention may feature a variety of sizes. For example, the small-medium size is preferably 1½"×4", and the large-extra-large size is preferably 1½"×6". Furthermore, the present invention is meant for single use.

The overall configuration provides a comfortable fit for the underside of a breast of a user while remaining stationery and absorbent. In order for the flat liner body 1 effectively collect the sweat from the breast of a user, the absorbent layer 2 is connected across the backing layer 3, seen in FIG. 1, FIG. 3, and FIG. 4. Moreover, the absorbent layer 2 and the backing layer 3 are coextensive with each other. The at least one piece of adhesive 9 is distributed across the backing layer 3, thereby effectively securing the desired position of the flat liner body 1 within the bra cup. The absorbent layer 2 remains uninhibited by the at least one piece of adhesive 9 and directly receives sweat from the breast pressed against the present invention as the at least one piece of adhesive 9 is fixed onto the backing layer 3, opposite to the absorbent layer 2.

In order to reinforce the shape and structure of the present invention while in use and throughout physical activity, the flat liner body 1 may further comprise a rim 4, seen in FIG. 1. The rim 4 is perimetrically positioned with the absorbent layer 2, preventing any sweat from escaping past the flat liner body 1. Moreover, the rim 4 is fixed onto the absorbent layer 2, opposite the backing layer 3, enhancing the comfort of the user and preventing the backing layer 3 from coming into contact with the skin of the user.

The present invention maximizes absorption of sweat from the breast of a user as the flat liner body 1 may further comprise a first lengthwise edge 5 and a second lengthwise edge 6, seen in FIG. 1. The first lengthwise edge 5 contours the underwire of a bra, and the second lengthwise edge 6 contours the curvature of the underside of a breast. The first lengthwise edge 5 is positioned opposite the second lengthwise edge 6 across the flat liner body 1, thereby defining a thickness of the flat liner body 1. More specifically, the first lengthwise edge 5 is convex, and the second lengthwise edge 6 is concave. This structure allows the flat liner body 1 to continuously press against the underside of the breast. In order to accommodate the natural shape of the breast, the first lengthwise edge 5 is positioned concentric with the second lengthwise edge 6. Moreover, the length of the first lengthwise edge 5 is larger than a length of the second lengthwise edge 6.

In order for the flat liner body 1 to not irritate the breast of a user while contouring around the underside of the breast, the flat liner body 1 may further comprise a first lateral end 7 and a second lateral end 8, seen in FIG. 1. The first lateral end 7 is positioned opposite the second lateral end 8 along the flat liner body 1, thereby defining a length for the flat liner body 1. The first lateral end 7 and the second lateral end 8 do not accidentally poke the breast of the user as the first lateral end 7 and the second lateral end 8 are convex.

Figure 2:
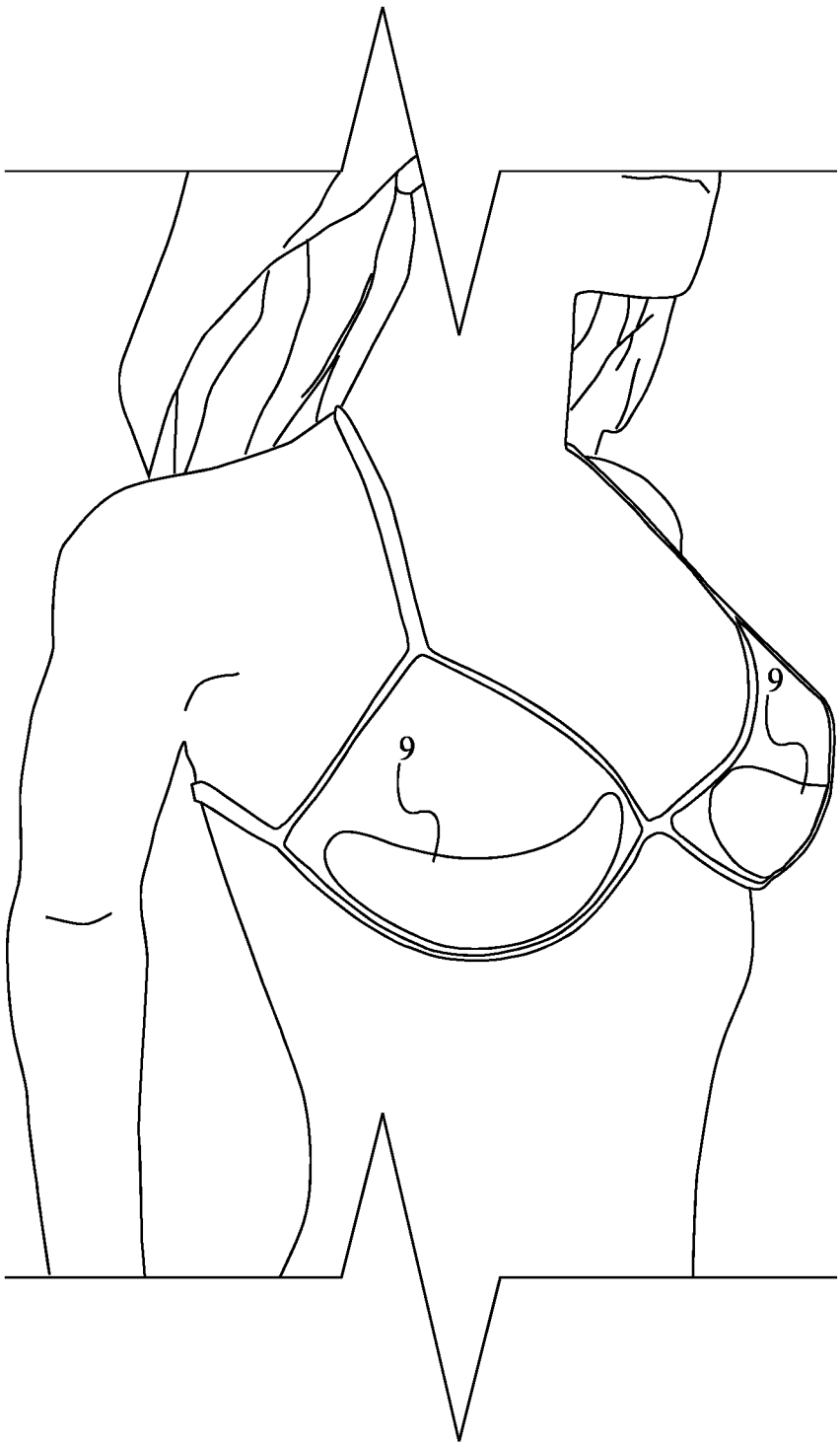
FIG. 2 is a rear perspective view of the present invention engaged with a bra cup.
Figure 3:
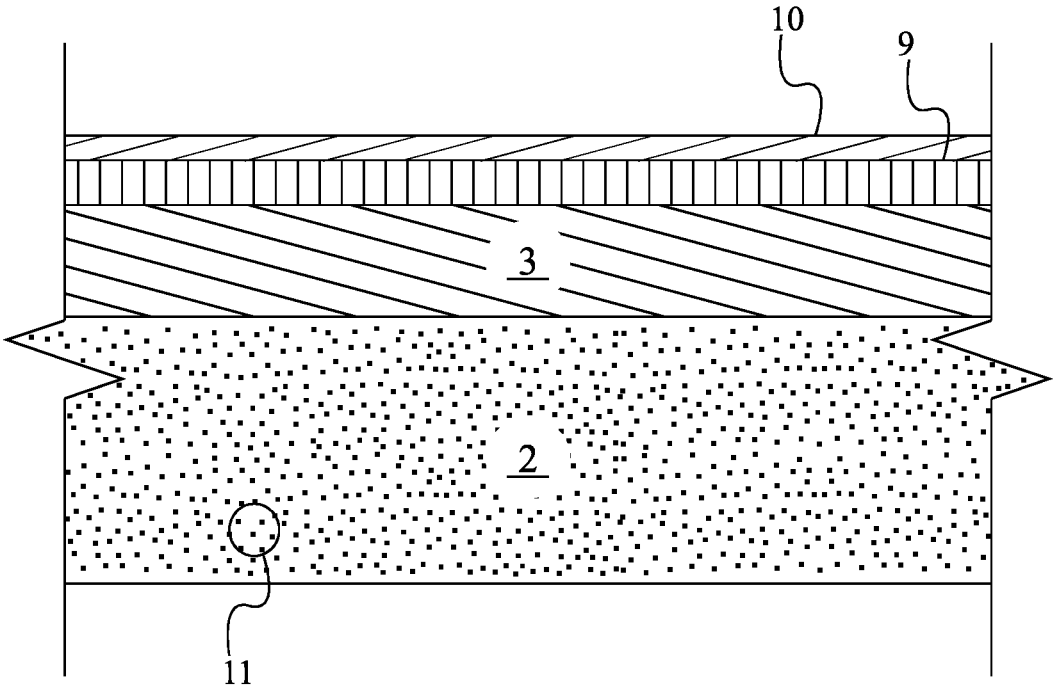
FIG. 3 is a schematic view of an absorbent layer, a backing layer, at least one piece of adhesive, and a sealing sheet.
Figure 4:
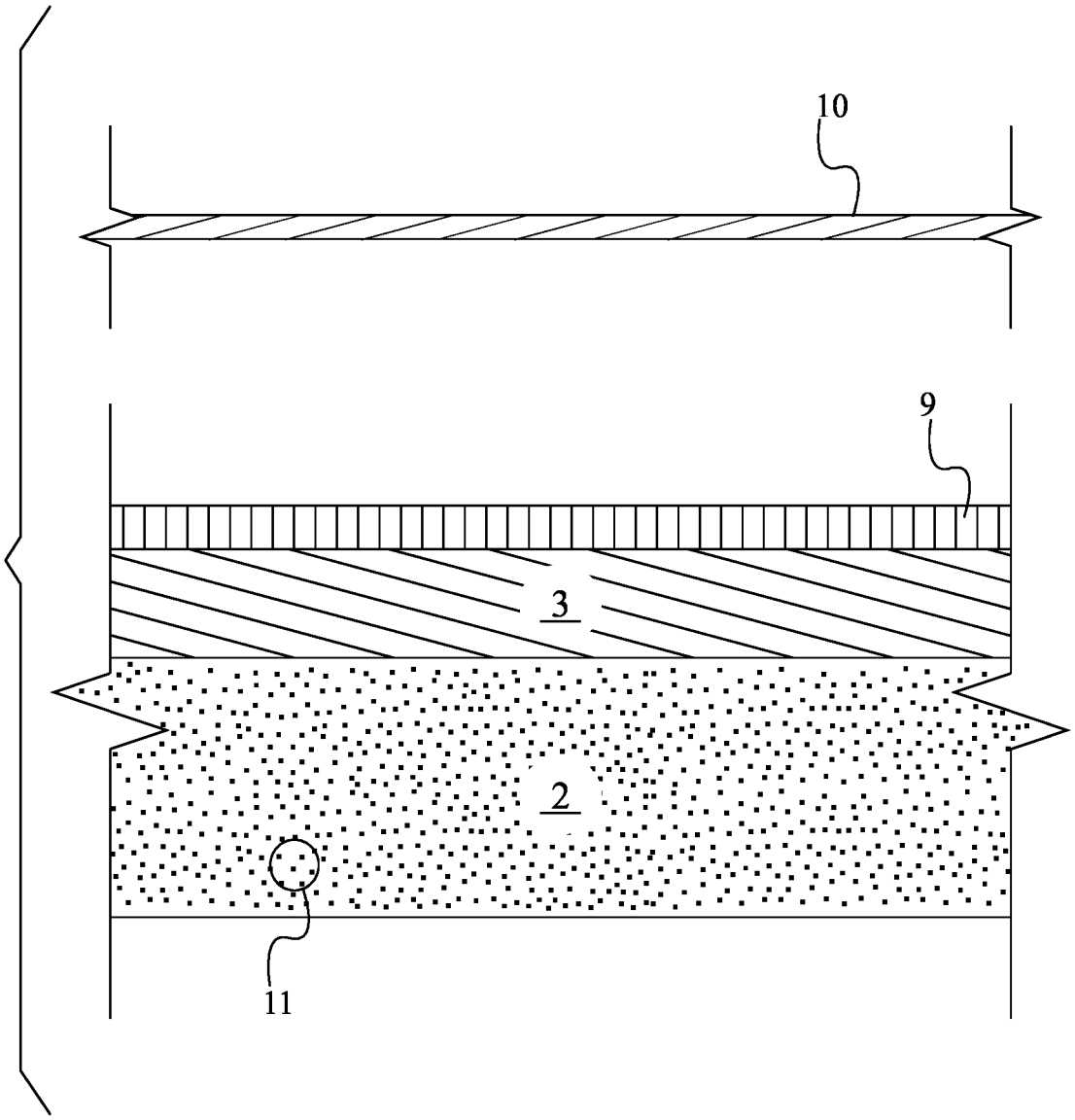
FIG. 4 is an exploded schematic view of the absorbent layer, the backing layer, at least one piece of adhesive separated from the sealing sheet.

The present invention may further comprise a sealing sheet 10 as to preserve the at least one piece of adhesive 9 until application with a bra cup, seen in FIG. 2, FIG. 3, and FIG. 4. The sealing sheet 10 prevents the at least one piece of adhesive 9 from sticking onto unwanted surfaces while not in use. The sealing sheet 10 is preferably made of waxed paper for easy removal and preservation of the at least one piece of adhesive 9. The sealing sheet 10 comes into direct contact with the at least one piece of adhesive 9 as the sealing sheet 10 is positioned adjacent with the at least one piece of adhesive 9, opposite the absorbent layer 2. The sealing sheet 10 is removably attached with the at least one piece of adhesive 9 so that the present invention may be readily applied to a bra cup, as seen in FIG. 4.

As the present invention collects and retains sweat, the present invention further enhances the overall hygiene of a user as the present invention may further comprise a quantity of fragrance 11, seen in FIG. 3 and FIG. 4. The quantity of fragrance 11 may comprise a variety of ingredients that compliment or override any smell as a result of excessive sweating around the chest area. The quantity of fragrance 11 is integrated into the absorbent layer 2 for full effectiveness.

Although the invention has been explained in relation to its preferred embodiment, it is to be understood that many other possible modifications and variations can be made without departing from the spirit and scope of the invention as hereinafter claimed.

What is claimed is:

1. A bra liner comprising: a flat liner body; at least one piece of adhesive; a sealing sheet a quantity of fragrance the flat liner body comprising an absorbent layer and a backing layer; the absorbent layer being made of a sweat-absorbing material: the backing layer being a perforated plastic film: the sealing sheet being made of waxed paper the absorbent layer being connected across the backing layer; the absorbent layer and the backing layer being coextensive with each other; the absorbent layer being configured to contact human breast skin and configured to receive sweat from the human breast skin the backing layer being configured to be offset from the human skin, configured to retain the sweat within the absorbent layer in between the human breast skin and the backing layer, and to prevent the sweat from contacting a bra cup pressed against the human breast skin; the at least one piece of adhesive being distributed across the backing layer; the at least one piece of adhesive being fixed onto the backing layer, opposite to the absorbent layer; the sealing sheet being positioned adjacent with the at least one piece of adhesive, opposite the absorbent layer the sealing sheet being removably attached with the at least one piece of adhesive: and the quantity of fragrance being integrated into the absorbent layer;

the flat liner body further comprising a protruding rim; the protruding rim being perimetrically positioned with the absorbent layer; and the protruding rim being fixed onto the absorbent layer, opposite the backing layer.

2. The bra liner as claimed in claim 1 comprising:

the flat liner body further comprising a first lengthwise edge and a second lengthwise edge;

the first lengthwise edge being positioned opposite the second lengthwise edge across the flat liner body;

the first lengthwise edge being convex;

the second lengthwise edge being concave;

the first lengthwise edge being positioned concentric with the second lengthwise edge; and, a length of the first lengthwise edge being larger than a length of the second lengthwise edge.

3. The bra liner as claimed in claim 1 comprising:

the flat liner body further comprising a first lateral end and a second lateral end;

the first lateral end being positioned opposite the second lateral end along the flat liner body; and, the first lateral end and the second lateral end being convex.

4. A bra liner comprising:

a flat liner body;

at least one piece of adhesive;

a sealing sheet;

a quantity of fragrance;

the flat liner body comprising an absorbent layer, a backing layer, a protruding rim, a first lengthwise edge, and a second lengthwise edge;

the absorbent layer being made of a sweat-absorbing material;

the backing layer being a perforated plastic film;

the sealing sheet being made of waxed paper;

the absorbent layer being connected across the backing layer;

the absorbent layer and the backing layer being coextensive with each other;

the absorbent layer being configured to contact human breast skin and configured to receive sweat from the human breast skin;

the backing layer being configured to be offset from the human skin, configured to retain the sweat within the absorbent layer in between the human breast skin and the backing layer, and to prevent the sweat from contacting a bra cup pressed against the human breast skin;

the at least one piece of adhesive being distributed across the backing layer;

the at least one piece of adhesive being fixed onto the backing layer, opposite to the absorbent layer;

the protruding rim being perimetrically positioned with the absorbent layer;

the protruding rim being fixed onto the absorbent layer, opposite the backing layer;

the first lengthwise edge being positioned opposite the second lengthwise edge across the flat liner body;

the first lengthwise edge being convex;

the second lengthwise edge being concave;

the first lengthwise edge being positioned concentric with the second lengthwise edge;

a length of the first lengthwise edge being larger than a length of the second lengthwise edge;

the sealing sheet being positioned adjacent with the at least one piece of adhesive, opposite the absorbent layer;

the sealing sheet being removably attached with the at least one piece of adhesive; and the quantity of fragrance being integrated into the absorbent layer.

5. The bra liner as claimed in claim 4 comprising:

the flat liner body further comprising a first lateral end and a second lateral end;

the first lateral end being positioned opposite the second lateral end along the flat liner body; and, the first lateral end and the second lateral end being convex.

* * * * *